United States Patent [19]

Thevenin et al.

[11] 4,041,866

[45] Aug. 16, 1977

[54] PROCESS FOR THE MANUFACTURE OF A BIMETALLIC FACING FOR HOLLOW CHARGES

[75] Inventors: Michel J. Thevénin, Paris; Michel Brun, Pau; Jacques Boileau, Paris; Joseph Pegoud, Arpajon, all of France

[73] Assignees: Societe Nationale des Poudres et Explosifs; Etat Francais, both of France

[21] Appl. No.: 568,265

[22] Filed: Apr. 15, 1975

[30] Foreign Application Priority Data

Apr. 17, 1974 France ..... 74.13409

[51] Int. Cl.[2] ..... F42B 1/02

[52] U.S. Cl. ..... 102/24 HC

[58] Field of Search ..... 102/24 HC; 228/107, 228/173, 157

[56] References Cited

U.S. PATENT DOCUMENTS

| | | | |
|---|---|---|---|
| 2,155,274 | 4/1939 | Kenah | 228/173 |
| 3,057,057 | 10/1962 | Langhans | 228/173 |
| 3,237,559 | 3/1966 | Auberlinder | 102/24 HC |
| 3,316,627 | 5/1967 | Suzuki et al. | 228/107 |
| 3,849,868 | 11/1974 | Jost | 228/155 |
| 3,895,436 | 7/1975 | Summers et al. | 228/173 |

*Primary Examiner*—Brooks H. Hunt

*Attorney, Agent, or Firm*—Bucknam and Archer

[57] ABSTRACT

The invention relates to a conical bimetallic facing for hollow charges and a process for the manufacture of a facing of this type comprising two successive stages:

a. explosive overlaying of two blanks of metals of different types, one of which metals produces a dense nozzle which is well drawn out, and the other of which metals is able to give rise to a core which disappears either by volatilisation or by disintegration under the conditions of elevated temperature and pressure which develop when the hollow charge is fired, and b. shaping the resulting bimetallic plate by conical flow turning, in order to obtain the desired conical bimetallic facing. The invention is applicable to the manufacture of a conical bimetallic facing for hollow charges.

4 Claims, 1 Drawing Figure

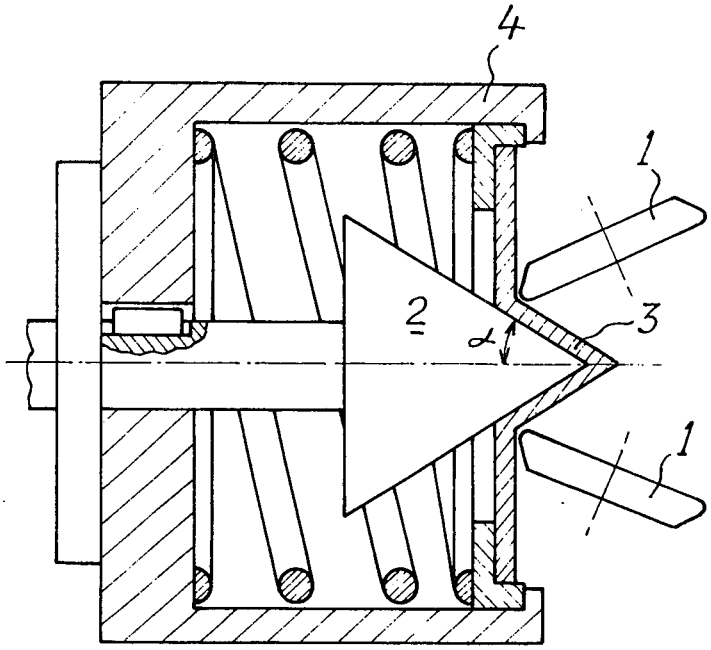
4
1
2
3
α
1

PROCESS FOR THE MANUFACTURE OF A BIMETALLIC FACING FOR HOLLOW CHARGES

The subject of the present invention is a process for the manufacture of a bimetallic facing for hollow charges.

Hollow charges are very widely used as a means of destroying armoured vehicles and also for putting oil wells into production. Hollow charges are based on the principle of the directional effect produced by an explosive charge which has an open cavity on one free side opposite the primed side.

A conventional hollow charge consists of a cylindrical stick of explosive, one end of which is hollowed out in accordance with a generally conical cavity which is itself covered by a generally conical metallic facing, a priming device being mounted at the other end opposite the said cavity.

When the charge is primed, the explosive detonates, and as the shock wave, which is propagated from the rear towards the front of the charge, passes through, the conical metallic facing collapses and is projected at high velocity, obliquely to the axis of the charge, starting at the apex and down to the base of the cone, so as to form, on the one hand, a penetrating jet, which has a small mass but is actuated by an extremely high velocity, moving along the said axis, and, on the other hand, a metallic core, which has a relatively large mass but follows the jet at a much lower velocity.

By means of the jet, the metallic facing thus plays a supporting role in transferring the energy of the explosive charge to the target. For this purpose, it is of value to produce the facing in a very ductile metal which has a high density, in particular copper or its alloys.

Nevertheless, a monometallic facing has the major disadvantage that the channel created by the jet issuing from the charge is blocked by the metallic core, the trajectory of which becomes confused with that of the said jet.

Proposals have already been made to remove the core by means of mechanical or pyrotechnic traps. However, these are in fact means which make it possible to stop the core in its trajectory or to divert it from the trajectory of the penetrating jet, rather than means for removing the core in the proper sense.

The fact that the penetrating jet is formed by the elements which originate in the inner layer i.e. the forward-pointing surface layer of the facing, on the side where the charge has a cavity, whilst the core is formed by the elements which originate in the outer layer i.e. the backward-pointing layer of the facing, on the side where the explosive is located, leads to a more attractive solution which consists of producing the facing in the form of two superimposed layers of metals of different types:

- an inner layer of copper or copper alloy or of another material from which a dense penetrating jet, which is well drawn out, can be produced;
- and an outer layer either of a metal having a low vaporisation point, such as zinc, lead, silver or aluminium, so that the core formed can rapidly disappear by volatilisation or of a metal of low ductility which can disintegrate in the course of firing, such as work-hardened steels.

The bimetallic facing has hitherto been produced:

- either by simultaneous stamping of two metal foils of different types, for example one copper foil and one zinc foil,
- or by metallizing one of the two layers onto the other which has previously been stamped,
- or by brazing two preformed metallic foils of different types.

The subject of the present invention is a process for the manufacture of a conical bimetallic facing for hollow charges; such a process comprises two successive stages:

a. explosive overlaying of two flat blanks of metals of different types, one of which metals is dense and ductile, and the other is a metal able to give rise to a core which disappears either by volatilisation or by disintegration under the conditions of elevated temperature and pressure which develop when the hollow charge is fired; and b. shaping the resulting bimetallic plate by conical flow turning, so as to obtain the conical bimetallic facing; in order to improve the planarity of the plated blanks, they can be subjected to a pressing or laminating operation before carrying out the flow turning.

In fact, only the process according to the invention enables bi-metallic facings to be used, which are composed of metals reputed to be metallographically incompatible or only slightly compatible. Thus, copper and aluminium, due to their different chemical natures and especially due to their incompatible crystallographical structures, cannot produce perfectly homogeneous composites. This is particularly serious in the case of flow turning being applied, which introduces severe tensions in the metal: the mechanical properties of copper and aluminium (for example) are very different, so much so that a bimetallic plate, obtained by the conventional methods and flow turned, has unequally distributed weaknesses. This results in a loss of accuracy concerning the direction of the jet as well as a dispersion and sometimes very substantial deviation of this latter.

Explosive overlaying of the two metallic blanks makes it possible to achieve very close bonding of the two metals at their interface and hence to carry out the entire flow turning process without causing cohesion to be lost at the interface; in particular, it makes it possible to achieve this very close bonding at the interface of metals which are difficult to weld together, in particular, copper with zinc or copper with aluminium.

Furthermore, flow turning of blanks overlaid by explosion has the following advantages over the technique of simultaneous stamping or of stamping followed by metallizing

- the production of bimetallic facings with high precision,
- good adhesion of the metals even if the metallizing fails,
- the possibility of using pairs of particular materials which can result in increased effectiveness of the facing, and
- making use of the particular properties conferred by the flow turning.

In fact, it is known that, by reason of the axial and tangential deformation conferred on the material by the flow turning, the copper facing of a hollow charge has the following property: if the facing is not itself impelled by a rotary movement, the jet is a spinning jet.

In the case of rotating facings, satisfactory flow turning makes it possible to obtain a non-spinning jet, that is to say a well compensated jet, on firing.

Furthermore, the creation of a spinning jet makes it possible to produce larger perforations in the target.

Furthermore, the use of a light metal, particularly aluminium, for producing the outer layer of the conical facing for hollow charges makes it possible to reduce the weight of the said facing.

Furthermore, the high quality of the bond between the two metals resists any separation of the two layers, which could result from a difference in acoustic impedance during the operation of the hollow charge. This separation would adversely affect the operation of the hollow charge.

In the example which follows and which does not imply any limitation, the invention is described by reference to the attached drawing on which the only FIGURE schematically represents a flow turning machine for shaping the facing according to the invention.

EXAMPLE

Production of a copper-aluminium bimetallic facing for hollow charges.

a. Overlaying

The overlaying is carried out using two sheets of 200 cm × 100 cm, one of copper 1 mm thick and the other of aluminium 5 mm thick, by means of an overlaying explosive having the following composition:

92.5% by weight of ammonium nitrate,
3.5% by weight of fuel oil and
4% by weight of wood flour, used in a layer 1.5 cm thick. The explosive is primed by commercial detonator of a force equivalent to 2 g of mercury fulminate.

The overlaid sheet thus obtained has a total thickness of 5.8 mm (that is a reduction in thickness of 0.2 mm). It is then cut into 100 × 100 mm flat blanks.

b. Flow turning

Each flat blank is shaped by flow turning in order to obtain a conical copper-aluminium bimetallic facing, (with the copper layer on the inside of the cone), having an angle of 60° at the apex of the cone.

The flow turning is carried out without a tail-stock on a turning mandrel having an angle of 60°, with two knurling tools of 310 mm diameter, the cutting radius of the knurling tool being 3 mm.

The conventional flow turning machine used, and diagrammatically shown in the only FIGURE on the attached drawing, is a BOHNER and KOHLE flow turning machine, type HYCOFORME D 50 HRH, with two knurling tools.

Each knurling tool 1 is mounted on a knurling tool carrier device and can be oriented around the axis of the said knurling tool carrier device. Each knurling tool carrier is firmly fixed to a carriage which can shift on a slide; the carriage-slide assembly can be oriented around an axis parallel to that of the knurling tool carrier; the slide can also be inclined by any desired angle relative to the axis of the mandrel 2.

Each knurling tool carrier can shift, vertically to the slide, by means of a piston which is located inside the carriage and is actuated by a hydraulic system. During the flow turning process, the piston rests on a mechanical stop; the position of this stop can be adjusted by a screw and determines the thickness of the part being flow-turned.

The part 3 to be flow-turned is firmly fixed to the mandrel by means of a device 4 called a driver which mechanically connects the edges of the blank to the mandrel. The speed of rotation of the mandrel is 324 revolutions/minute and the forward movement of the knurling tools is adjusted to 0.2 mm/revolution per knurling tool.

c. Hollow charge

The copper-aluminium bimetallic facing thus obtained was used on a hollow charge which comprised an explosive charge consisting of 190 g of hexolite primed by a relay of 32 g of tetryl. The outer diameter of the hollow charge was 89 mm.

In test firings, this hollow charge fitted with the bimetallic facing according to the invention, made it possible to perforate a 450 mm thick steel target, without the perforation becoming blocked by the core.

Moreover, the use of a copper-aluminium bimetallic facing permits a saving in weight of about 70 g compared with an equivalent facing produced entirely in copper.

Thus, the choice of a light metal, in particular aluminium, as the outer layer of the bimetallic facing for hollow charges gives a considerable weight advantage, at equal perforation efficiency, in addition to the fact that the core formed is rapidly volatilised under the action of the high temperatures which develop during the firing of the said hollow charge.

The technique according to the invention has been described by reference to cavities in conical hollow charges. A cone is to be understood, in a general manner, as a surface of revolution, the meridian line of which is either formed by two straight lines or has the shape of a parabola approaching two straight lines.

What we claim is:

1. Process for the manufacture of a conical bimetallic facing for hollow charges, characterized in that it comprises two successive stages:

a. explosive overlaying of two blanks of metals of different types, one of which metals is intended to form the inside of the conical facing and is copper or a copper alloy and the other of which metals is able to give rise to a core which disappears either by volatilisation or by disintegration under the conditions of elevated temperature and pressure which develop when the hollow charge is fired, and is intended to form the outside of the conical facing and is aluminium, and b. shaping the resulting bimetallic plate by conical flow turning, in order to obtain the desired conical bimetallic facing.

2. Process according to claim 1, characterised in that the ratio of the initial thicknesses of the copper and the aluminium is 1/5.

3. Bimetallic facing for hollow charges obtained in accordance with the process described in claim 1.

4. Hollow charge fitted with a bimetallic facing according to claim 3.

* * * * *